US009248503B2

(12) United States Patent
Chiesa et al.

(10) Patent No.: US 9,248,503 B2
(45) Date of Patent: Feb. 2, 2016

(54) POWDER METAL FORGING AND METHOD AND APPARATUS OF MANUFACTURE

(75) Inventors: Alfred J. Chiesa, Farmington Hills, MI (US); Hank J. Knott, Ypsilanti, MI (US); David E. Lenhart, Pomeroy, OH (US)

(73) Assignee: GKN Sinter Metals, LLC, Auburn Hills, MI (US)

( * ) Notice: Subject to any disclaimer, the term of this patent is extended or adjusted under 35 U.S.C. 154(b) by 720 days.

(21) Appl. No.: 12/532,561

(22) PCT Filed: Apr. 1, 2008

(86) PCT No.: PCT/US2008/058980

§ 371 (c)(1), (2), (4) Date: Sep. 22, 2009

(87) PCT Pub. No.: WO2008/124378

PCT Pub. Date: Oct. 16, 2008

(65) Prior Publication Data

US 2010/0083782 A1 Apr. 8, 2010

Related U.S. Application Data

(60) Provisional application No. 60/910,027, filed on Apr. 4, 2007.

(51) Int. Cl.

| | |
|---|---|
| ***B21D 22/20*** | (2006.01) |
| ***B22F 5/08*** | (2006.01) |
| ***B22F 3/17*** | (2006.01) |

(52) U.S. Cl.

CPC . *B22F 5/085* (2013.01); *B22F 3/17* (2013.01); *B22F 2998/00* (2013.01); *B22F 2998/10* (2013.01); *Y10T 29/49467* (2015.01); *Y10T 29/49469* (2015.01); *Y10T 74/19953* (2015.01)

(58) Field of Classification Search

CPC ..... B22F 3/17
USPC ..... 419/28
See application file for complete search history.

(56) References Cited

U.S. PATENT DOCUMENTS

| | | | |
|---|---|---|---|
| 3,694,127 | A | 9/1972 | Takahashi et al. |
| 3,842,646 | A | 10/1974 | Kuhn |

(Continued)

FOREIGN PATENT DOCUMENTS

| | | |
|---|---|---|
| GB | 618009 | 2/1949 |
| JP | S60-009546 | 1/1985 |
| WO | PCT/US2010/060066 | 12/2010 |

OTHER PUBLICATIONS

PCT International Search Report for PCT/US08/53389 mailed Jun. 5, 2008.
PCT International Search Report for PCT/US07/87149 mailed Aug. 19, 2008.

(Continued)

*Primary Examiner* — Jessee Roe
*Assistant Examiner* — Christopher Kessler
(74) *Attorney, Agent, or Firm* — Quarles & Brady LLP

(57) ABSTRACT

A method of forming a powder metal forging, which includes the steps of providing a preform including a sintered powder metal composition; inserting the preform in at least one part of a die set having a top die and a bottom die, at least one of the top die and the bottom die defining a helical forge form therewithin; closing the die set wherein the top die is contacting the bottom die; and compressing the preform in the forge form using an upper punch including a core rod and a lower punch, the compressing step occurring after the closing step, the compressing step resulting in a formed part having a helical outer surface. The method and apparatus of the present invention is particularly advantageous when forming a powder metal forging helical outer surface and an inner contour such as a cylindrical inside diameter.

21 Claims, 5 Drawing Sheets

(56) References Cited

U.S. PATENT DOCUMENTS

| | | | | |
|---|---|---|---|---|
| 3,891,367 | A | 6/1975 | Signora | |
| 4,038,860 | A | 8/1977 | Kanamaru et al. | |
| 4,051,590 | A | 10/1977 | Halter et al. | |
| 4,165,243 | A | 8/1979 | Sarnes et al. | |
| 4,712,411 | A | 12/1987 | Goodwin | |
| 5,718,774 | A | 2/1998 | Tukamoto et al. | |
| 6,630,101 | B2 | 10/2003 | Anderson et al. | |
| 6,730,263 | B2 | 5/2004 | Ernst et al. | |
| 7,364,803 | B1 * | 4/2008 | Anderson | 428/687 |
| 2003/0035747 | A1 | 2/2003 | Anderson et al. | |
| 2003/0049151 | A1 | 3/2003 | Wehler | |
| 2005/0278952 | A1 | 12/2005 | Ooka | |
| 2007/0221005 | A1 | 9/2007 | Geiman | |
| 2010/0035077 | A1 | 2/2010 | Chiesa | |
| 2011/0000335 | A1 | 1/2011 | Chiesa | |

OTHER PUBLICATIONS

Inernational Search Report and Written Opinion Corresponding to PCT/US08/058980 under date of mailing of Aug. 21, 2008.

PCT International Search Report for PCT/US2010/060066, mailed Feb. 11, 2011.

First Office action in China for related Chinese application No. 2008800114128; mailed Nov. 8, 2010; 12 pages.

Second Office action in China for related Chinese application No. 2008800114128; mailed Apr. 7, 2011; 12 pages.

Third Office action in China for related Chinese application No. 2008800114128; mailed Nov. 16, 2011; 2 pages.

Fourth Office action in China for related Chinese application No. 2008800114128; mailed Apr. 17, 2012; 10 pages.

Extended European Search Report dated Feb. 25, 2014; 8 pages.

* cited by examiner

POWDER METAL FORGING AND METHOD AND APPARATUS OF MANUFACTURE

CROSS-REFERENCES TO RELATED APPLICATIONS

This application claims priority from U.S. Provisional Patent Application No. 60/910,027 filed Apr. 4, 2007.

STATEMENT REGARDING FEDERALLY SPONSORED RESEARCH

Not Applicable.

BACKGROUND OF THE INVENTION

1. Field of the Invention

The present invention relates to powder metal forgings and the manufacture thereof, and, more particularly, to powder metal forgings having a helical outer contour or profile, and an inside contour.

2. Description of the Related Art

In the manufacture of near net shape parts, for example a helical gear or inner race of a constant velocity joint (CVJ), one method of manufacture is a wrought forging process that provides near net shaped parts, which requires precision blanks machined prior to the forging process. Further, in the case of wrought forged gears or a CVJ inner race, or other part, which may have an inside diameter, the inside diameter must be pierced, which is additional material waste and cost.

A method and apparatus is known for producing in a single stroke a forged metal article with a helical contoured surface. The apparatus uses an upper punch with a generally smooth surface which is telescopically received in a punch housing and a lower punch of generally smooth surface which is mounted for free rotation with respect to the axis of the die assembly. However, this process provides a simple tooling arrangement for forging pinions with no inside diameter present. Further, there can be considerable flash formed on the part as a result of the single stroke simultaneously closing the dies and compressing the preform with the punch.

During powder metal forging, there is considerable force upward that tends to separate the upper die from the lower die and allows a shoulder to form on the part instead of a thin flash parting line. In the case of gear manufacturing this undesirable movement of the tool member causes lower density in the teeth and non-fill of the tooth form. More material and tonnage is required to fill the teeth in the part, but also allows for the formed shoulder (flash) to become larger as a result. This additional material is required to be machined off as a secondary process along with the inside diameter since there is no provision in this process to form the inside diameter in the forging process. The result is wasted material and additional processing which drives up cost. This old method also uses very weak upper tooling where the outer punch can be prone to cracking in some gear configurations.

What is needed in the art is a powder metal forging and method and apparatus of manufacture, and powder metal forgings manufactured therefrom, which produces a powder metal forging with a helical outer profile and an inside contour.

SUMMARY OF THE INVENTION

In one aspect, the invention provides a method of forming a powder metal forging. In the method, a preform including a sintered powder metal composition is inserted in at least one part of a die set having a top die and a bottom die. At least one of the top die and the bottom die defines a helical forge form therewithin. The die set is closed such that the top die is contacting the bottom die. Then the preform is compressed in the forge form using an upper punch and a lower punch resulting in a formed part having a helical outer surface. The method can include forming an inside contour of the formed part wherein the inside contour is a generally cylindrical inside diameter.

The upper punch can include a core rod at a lower extent of the upper punch such that the inside contour is formed using the core rod. Optionally, the lower punch can include a lower core rod which is inserted into the preform when forming the powder metal forging. The method can include raising the top die from the bottom die thereby creating an interstice between the top die and the bottom die, and stripping the formed part from the bottom die into the interstice using the lower punch. In one version, the lower punch is rotated during stripping the formed part from the bottom die. The method can include ejecting the formed part from the die set.

The preform can be a noncylindrical preform. The preform can include a first end section having a first outside diameter and a second end section having a second outside diameter wherein the first outside diameter is greater than the second outside diameter. The first end section and the second end section of the preform can create a shoulder on the preform so that the shoulder can be positioned below the upper die after closing the die set. The first end section of the preform can be positioned in the helical forge form after closing the die set. The preform can include a cylindrical inner contour connecting the first end section and the second end section of the preform. The perform can have a density in a range of approximately between 6.5 g/cm$^3$ and 8.0 g/cm$^3$.

The method can include applying a clamping force to the top die and the bottom die after closing the die set. In the method, compressing the preform in the forge form causes the preform to flow laterally. The lower punch and the formed part can be formed to mate with each other to provide a positive rotary engagement between them to aid in ejection. Preferably, the bottom die defines the helical forge form therewithin. In one form, an inside diameter of the preform and an inside diameter of the formed part are the same.

In another aspect, the invention provides a tooling arrangement for forming a powder metal forging having an outer contour including a helical form. The tooling arrangement can include an upper ram, a cylinder connected to the upper ram, an upper outer die that is contacted by the cylinder, and a lower die including an upper side that is contacted by the upper outer die when the upper ram is in a down stroke. A lower punch is positioned in an opening in the lower die. The lower punch includes a central cavity. An upper punch contacts the upper ram and is guided by a central opening in the upper outer die. The upper punch includes a core rod at a lower extent of the upper punch, and the core rod is inserted into the central cavity of the lower punch when forming the powder metal forging.

The bottom die can define a helical forge form therewithin, and the helical forge form can have an outer diameter greater than an inside diameter of the central opening in the upper outer die. The helical forge form can have an outer diameter greater than an inside diameter of the opening in the lower die. The tooling can include means for rotating the lower punch during stripping the formed part from the bottom die. The lower punch and the formed part can be formed to mate with each other to provide a positive rotary engagement between them to aid in ejection of the formed part.

In yet another aspect, the invention provides a tooling arrangement for forming a powder metal forging having an outer contour including a helical form. The tooling arrangement can include an upper ram, a cylinder connected to the upper ram, an upper outer die contacted by the cylinder, and a lower die including an upper side that is contacted by the upper outer die when the upper ram is in a down stroke. An upper punch is guided by a central opening in the upper outer die. The upper punch includes a central cavity. A lower punch is guided by an opening in the lower die. The lower punch includes a core rod at an upper extent of the lower punch, and the core rod can be inserted into the central cavity of the upper punch when forming the powder metal forging. The upper die can define a helical forge form therewithin, and the helical forge form can have an outer diameter greater than an inside diameter of the opening in the lower die. The helical forge form can have an outer diameter greater than an inside diameter of the central opening in the upper die.

In still another aspect, the invention provides a powder metal forging. The forging can include a first end, a second end opposed to the first end, an inner contour connecting the first end and the second end, and an outer contour connecting the first end and the second end. The outer contour can include a plurality of protrusions. The powder metal forging is formed by compressing a preform including a sintered powder metal composition, and each of the plurality of protrusions has an approximately uniform density. In one form, each of the plurality of protrusions extends from the first end and the second end. The inner contour can include a cylindrical inside diameter. The approximately uniform density can be in a range of approximately between 6.5 g/cm$^3$ and 8.0 g/cm$^3$. The plurality of protrusions can be helical. The plurality of protrusions can be helical gear teeth. The first end can have a annular raised section including a top surface and a sloping outer surface.

Advantages of the present invention are that it provides a powder metal forging, and method and apparatus of manufacture thereof, and powder metal forgings manufactured therefrom, which produce a powder metal forging with a helical outer profile and an inside contour.

Another advantage of an embodiment of the present invention is that it can provide a helical gear with a uniform material density in the teeth.

Another advantage of an embodiment of the present invention is that it can provide a manufacturing apparatus and method, and devices produced therefrom, other than a helical gear, but which need complete or nearly complete lateral flow of material during the forging process.

Yet another advantage of an embodiment of the present invention is that it can be used with a preform of a relatively high density.

Yet another advantage of an embodiment of the present invention is that it provides a powder forge technique with a greater ability to define what the blank should look like to enhance material flow.

Yet other advantages of an embodiment of the present invention are that it provides a powder forged process where the inside diameter is included in the blank and forged to size with no loss of material.

Yet other advantages of an embodiment of the present invention is that it provides a new method which allows for better clamping of the upper and lower tool members and also allows for forming the inside diameter of the part whether round or contoured.

Yet other advantages of an embodiment of the present invention is that it can now forge in the inside diameter, strengthen the tool set to handle a wider variety of tooth forms in the forged powder metal (PM) part, and keep the upper and lower tools closed during the forging process to have a very consistent tooth form with a small flash line, which reduces the material and machining cost and produces a superior blank for subsequent machining operations.

Yet another advantage of an embodiment of the present invention is that it provides a cost effective way of manufacturing an inner race of a helical gear or other parts, such as a constant velocity joint.

Yet another advantage of an embodiment of the present invention is that it can be used to manufacture complex flash free parts which eliminates or minimizes material waste.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

Corresponding reference characters indicate corresponding parts throughout the several views. The exemplifications set out herein illustrate one example embodiment of the invention, in one form, and such exemplifications are not to be construed as limiting the scope of the invention in any manner.

DETAILED DESCRIPTION OF THE INVENTION

Figure 1A:
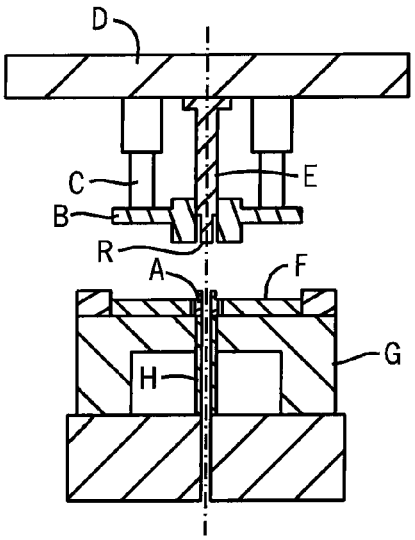
FIGS. 1A-1D are a series of cross-sectional schematic views illustrating an embodiment of the method and apparatus, and a powder metal forging, according to the present invention.

Referring now to the drawings, and more particularly to FIGS. 1A-1D, there is shown a method and apparatus of forming a powder metal forging 10, which can include a preform A, an upper outer sleeve or die B, cylinders C, upper ram D, an upper punch E having a core rod R at its lower extent, a lower die F which in conjunction with an upper outer sleeve or die B comprises a die set, a lower pedestal G, and a lower punch H. Optionally, lower punch H can include a lower core rod (not shown) at its upper extent.

One example preform A includes a powder metal composition which has been compacted and then sintered. A non-limiting example composition of the powder metal includes approximately between 0.40% and 2.00% of nickel, approximately between 0.50% and 0.65% of molybdenum, approximately between 0.10% and 0.35% of manganese, approximately between 0.12% and 0.80% of carbon, and balance iron.

Figure 1B:
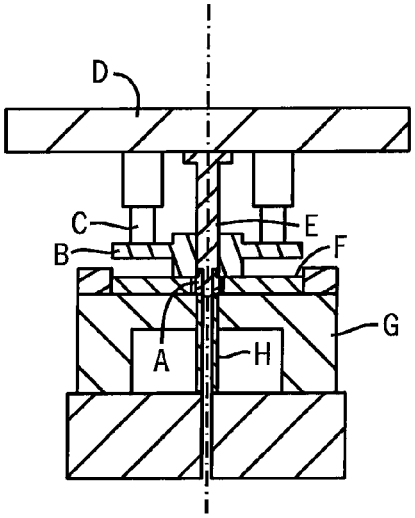

In FIG. 1A, preform A is loaded into die cavity 12. Both preform A and die cavity 12 are designed specifically for a corresponding powder metal forging 10. Referring now to FIG. 1B, upper ram D moves down, and upper outer die B contacts lower die F and envelopes a portion of preform A prior to forging, so as to close the upper outside portion of the die cavity. Upper punch E and core rod R start to contact preform A but no work is done on preform A at this time. The clamping force between cylinders C and lower die F is starting at this point; however, such a clamping force is not limited to the arrangement shown, but can also include other elements. The dies may be held together by any suitable mean, including nitrogen charged cylinders as illustrated, mechanical locks or other means that may not necessarily be carried by the upper ram D.

Figure 1C:
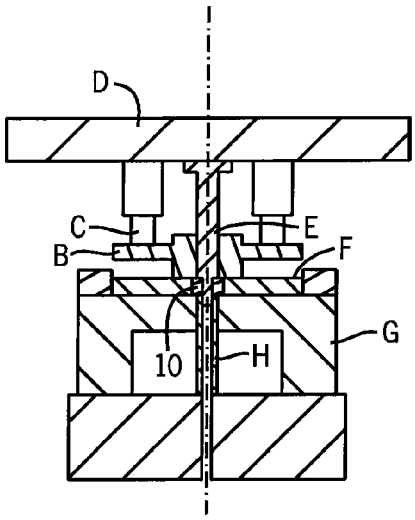
Figure 1D:
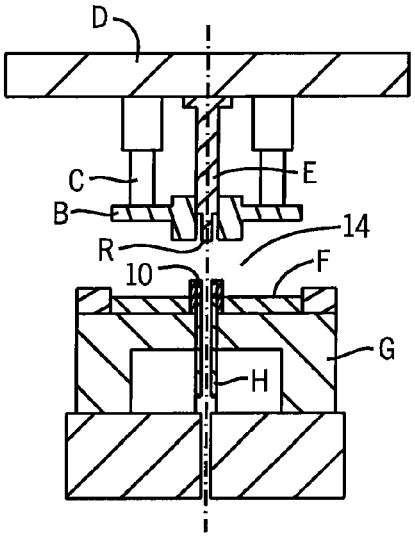

Referring now to FIG. 1C, upper ram D continues downward thereby compressing cylinders C further adding more clamping pressure to lower die F to ensure that upper outer sleeve B remains in contact with lower die F at all times during the forging process. Upper punch E and core rod R compress against preform A to form the finished powder metal forging 10.

In order to eject powder metal forging 10 (FIG. 1D), upper ram D releases and moves up to the top stroke position, while upper outer die B remains in contact with lower die F until cylinders C reach the end of their stroke, after which further upward motion creates an interstice 14 between upper outer die B and lower die F. This aids in the stripping of powder metal forging 10 off of upper punch E and core rod R. Lower punch H rotates while ejecting powder metal forging 10, to aid in ejecting the helical form on the outer profile of powder metal forging 10, to "unscrew" it from the lower die. If necessary, the top of the punch H and the bottom of the forging 10 can be formed to mate with each other to provide a positive rotary engagement between them to aid in ejection. As upper outer die B and lower die F are contacting prior to upper punch E and core rod R compressing against preform A, preform A can have a relatively higher density in the range of approximately between 6.5 g/cm$^3$ and 8.0 g/cm$^3$.

The resulting powder metal forging 10 can include a first end, a second end opposed to the first end, an inner contour which connects the first end and the second end, and an outer contour which connects the first end and the second end, where the outer contour comprises a helical form.

The inner contour can comprises a cylindrical inside diameter, for example, or other shapes such as splines, keyways, internal gears, other shapes and the like. The outer contour can include a plurality of protrusions extending from the first end and the second end, where each of the protrusions has an approximately uniform density. The approximately uniform density is in a range of approximately between 6.5 g/cm$^3$ and 8.0 g/cm$^3$. The helical form can comprise a plurality of helical gear teeth, helical flutes or lands, or other helical shapes.

Figure 2:
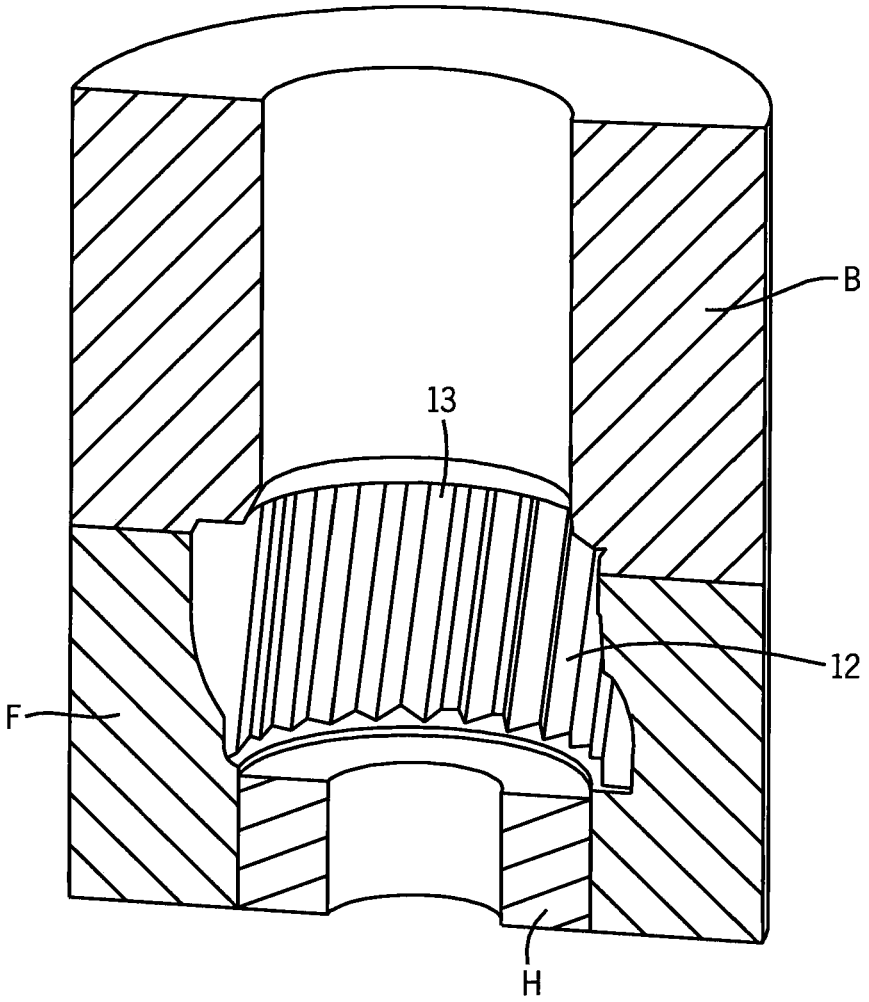
FIG. 2 is a fragmentary cross-sectional perspective view of the die set, and lower punch, of FIGS. 1A-1D, particularly illustrating a helical forge form therewithin.
Figure 3:
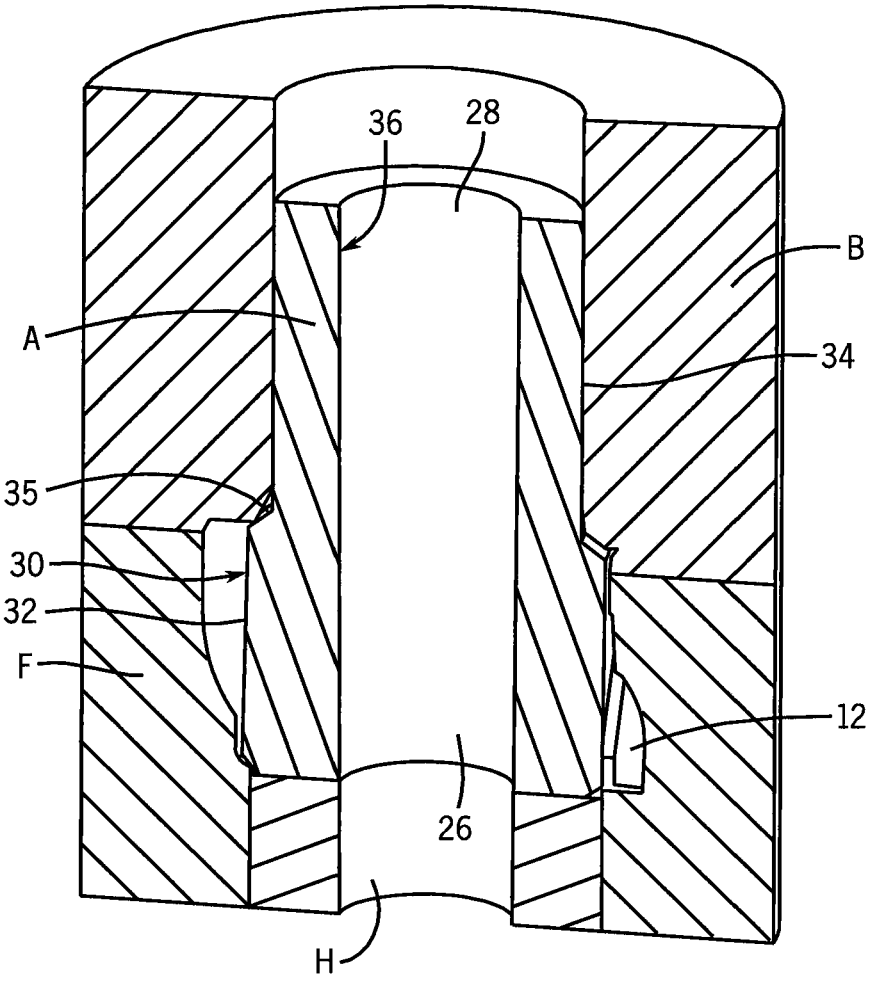
FIG. 3 is a fragmentary cross-sectional perspective view of the die set, and lower punch, of FIG. 2, with a powder metal preform inserted therein.
Figure 4:
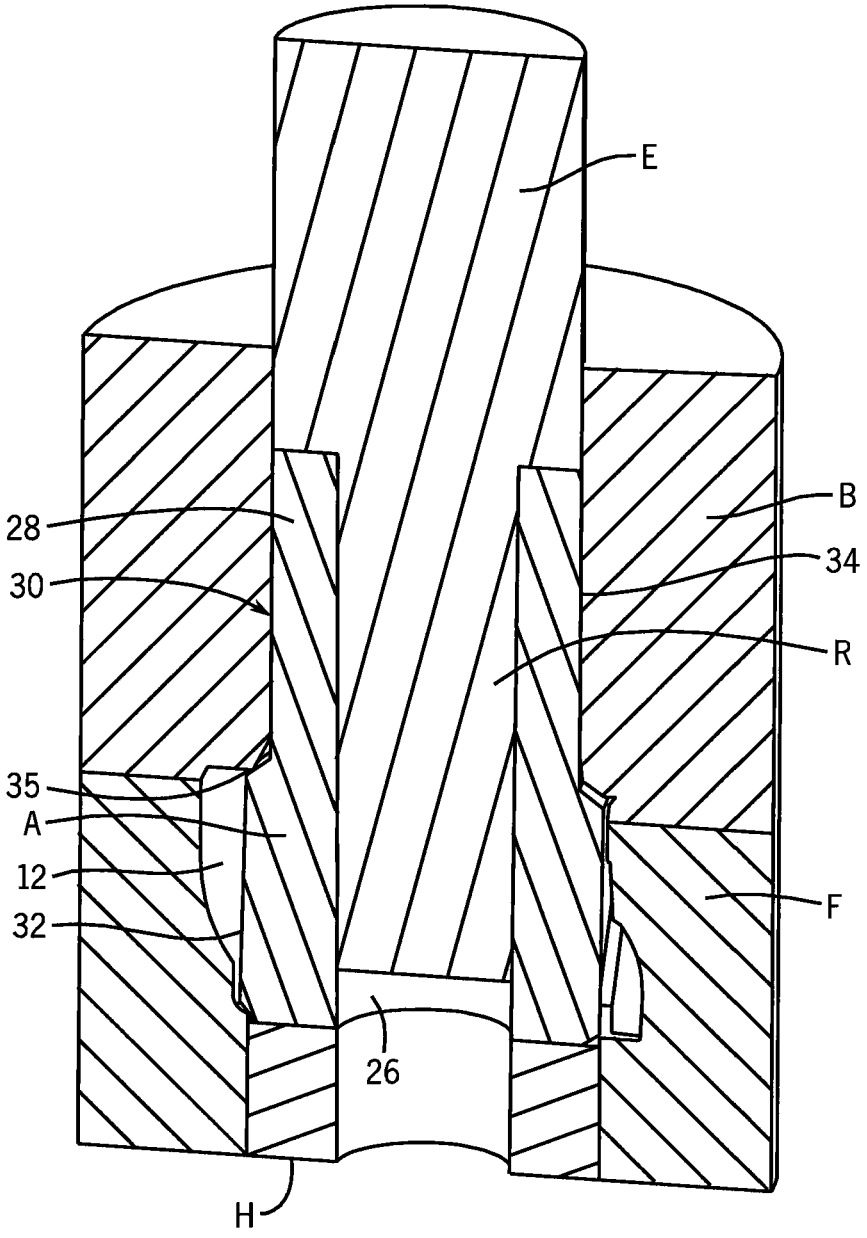
FIG. 4 is a fragmentary cross-sectional perspective view of the die set, preform, lower punch, of FIG. 3, and an upper punch inserted therein.

FIG. 2 is a fragmentary cross-sectional perspective view of upper outer die B, lower die F and lower punch H, showing particularly the helical forge form 13 of die cavity 12. FIG. 3 is a fragmentary perspective view similar to FIG. 2, but additionally showing preform A therewithin. FIG. 4 is a fragmentary perspective view similar to FIG. 3, but additionally illustrating upper punch E and core rod R as they begin to work on preform A.

Looking at FIG. 3, preform A is a noncylindrical preform which includes a first lower end 26, a second upper end 28 opposed to first end 26 and an outer contour 30 connecting first end 26 and second end 28. The outer contour 30 includes a lower first section 32 having a greater outside diameter than an upper second section 34 of the outer contour 30. An intermediate shoulder 35 connects the lower section 32 and the upper section 34 of the outer contour 30. An inner contour 36 also connects first end 26 and second end 28, where inner contour 36 is generally cylindrical. It can be advantageous for the preform to be of a relatively high density as this yields better properties in the forged part, although generally as the density of the material goes up the flowability goes down. The wider lower section 32 of the outer contour 30 provides additional strength to preform A.

Figure 5:
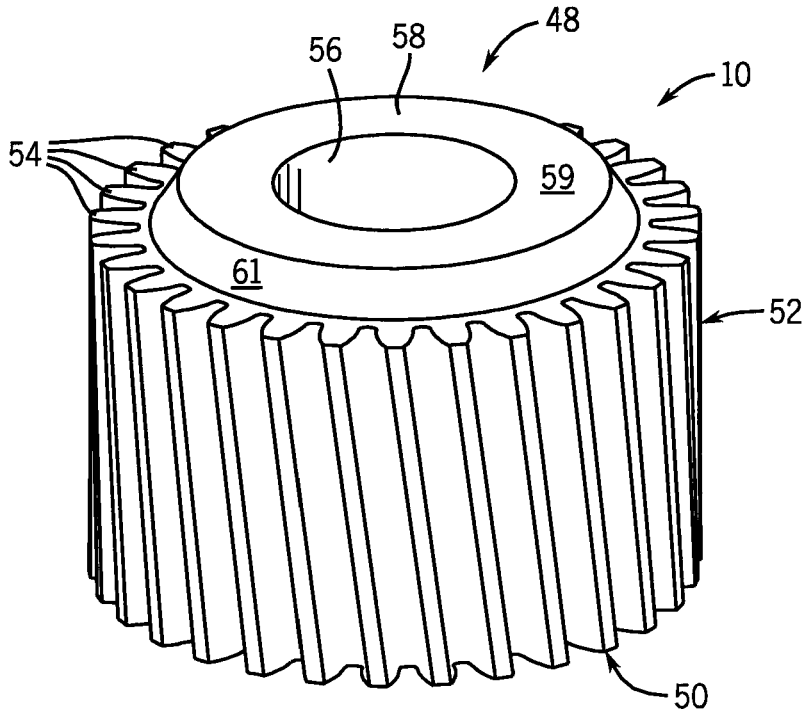
FIG. 5 is a perspective view of a powder metal forging with an outer contour comprising a helical form, according to the present invention.

The resulting powder metal forging 10 (see particularly FIG. 5) is manufactured from sintered powder metal preform A, in a forging process according to the present invention, and can be flash free, or can have a minimum of flash, as dies B and F remain in contact during the forging process. The present invention can include other steps and/or elements as are known in the powdered metal industry.

The powder metal forging 10 includes a first end 48, a second end 50 opposed to first end 48, and an outer contour 52 connecting first end 48 and second end 50. The outer contour 52 has a plurality of longitudinal protruding teeth 54 wherein leading edges of the teeth 54 are not parallel to the longitudinal axis of the powder metal forging 10. The teeth 54 extend from the first end 48 to the second end 50 of the powder metal forging 10. An inner contour 56 also connects first end 48 and second end 50, where inner contour 56 is generally cylindrical. The first end 48 has an annular raised section 58 with a top surface 59 and a sloping outer surface 61.

Figure 6:
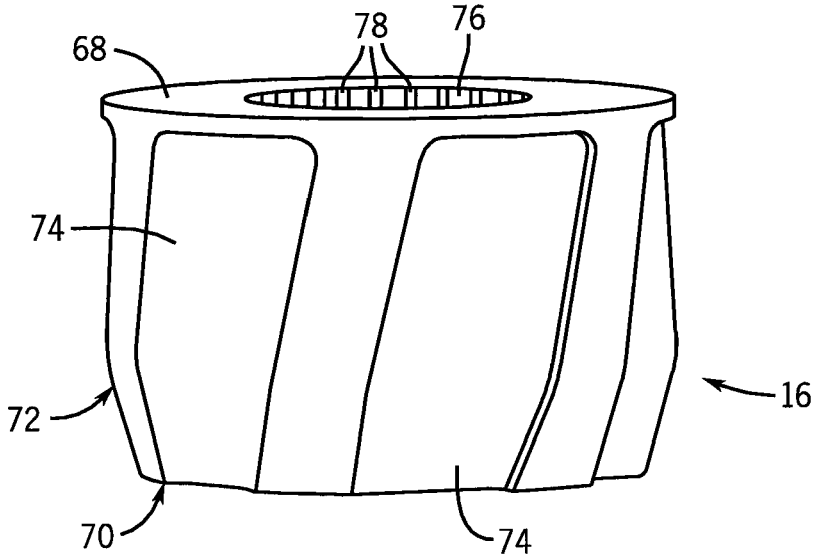
FIG. 6 is a perspective view of another powder metal forging with an outer contour comprising a helical form, according to the present invention.

Although the method and apparatus illustrated in FIGS. 1A to 4 is particularly suited to forming a powder metal forging 10 such as a helical gear, this new process can also be used on other products other than the stated helical gear, and can broadly be used to manufacture products that require complete lateral flow of the material. For example, some constant velocity joints can benefit from the present invention when compared to known methods. FIG. 6 illustrates a forged blank 16 including a first end 68, a second end 70 opposed to first end 68, and an outer contour 72 connecting first end 68 and second end 70. The outer contour 72 has a plurality of grooves 74 wherein the grooves 74 are not parallel to the longitudinal axis of the forged blank 16. An inner contour 76 also connects first end 68 and second end 70, where inner contour 76 has a splines 78. In the case of a constant velocity joint finished part, the grooves 74 can be machined straight for the finished part, no helix, but still allow the forging to be made with minimum stock.

While this invention has been described as having an exemplary design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

INDUSTRIAL APPLICABILITY

The invention relates to powder metal forgings and the manufacture thereof and, more particularly, to powder metal forgings having a helical outer contour or profile, and an inside contour.

What is claimed is:

1. A method of forming a powder metal forging, the method comprising the sequential steps of:

inserting a preform in at least one part of a die set having a top die and a bottom die with a lower punch received therein, wherein the preform has a sintered powder metal composition and includes an upper section, a lower section, and an intermediate shoulder connecting the upper section and the lower section;

closing the die set such that the top die is contacting the bottom die to define a parting line between the top die and the bottom die; and compressing the preform in the die set using an upper punch having a core rod at a lower extent of the upper punch, thereby resulting in the powder metal forging having an inner contour.

2. The method of claim 1, wherein the preform includes an inner contour connecting the upper section and the lower section.

3. The method of claim 1, wherein the lower section of the preform has a greater outside diameter than the upper section of the preform.

4. The method of claim 1, wherein the intermediate shoulder of the preform is positioned below the top die after closing the die set.

5. The method of claim 4, wherein the top die extends below the intermediate shoulder of the preform and terminates at a parting line between the two dies that is spaced below the intermediate shoulder when the dies are closed.

6. The method of claim 1, wherein the inside contour of the powder metal forging is formed by the core rod at the lower extent of the upper punch.

7. The method of claim 1, wherein the core rod is integral with the upper punch.

8. The method of claim 1, wherein at least one of the top die and the bottom die define a helical forge form therewithin and the powder metal forging has a helical outer surface.

9. The method of claim 8, wherein the bottom die defines the helical forge form therewithin.

10. The method of claim 9, wherein the helical forge form has an outer diameter greater than an inside diameter of a central opening in the top die.

11. The method of claim 1, wherein a shoulder of the top die is disposed above the parting line and defines a portion of a profile of the powder metal forging and wherein flash formation is inhibited at the parting line during the step of compressing the preform in the die set.

12. The method of claim 1, further comprising:

raising the top die from the bottom die thereby creating an interstice between the top die and the bottom die, and stripping the powder metal forging from the bottom die into the interstice using the lower punch, and rotating the lower punch during stripping of the powder metal forging from the bottom die.

13. The method of claim 1, further comprising:

applying a clamping force to the top die and the bottom die after closing the die set.

14. The method of claim 1, wherein compressing the preform in the forge form causes the material of the preform to flow laterally.

15. The method of claim 1, wherein the lower punch and the powder metal forging are formed to mate with each other to provide a positive rotary engagement between them to aid in ejection.

16. The method of claim 1, wherein an inside diameter of the preform and an inside diameter of the powder metal forging are substantially the same.

17. The method of claim 1, wherein the inner contour of the powder metal forging comprises at least one of a cylindrical inside diameter, splines, and keyways.

18. The method of claim 1, wherein the powder metal forging is an inner race part for a constant velocity joint.

19. The method of claim 1, wherein the powder metal forging is a helical gear.

20. The method of claim 1, wherein the upper punch forms both an upper facing surface of the powder metal forging and an inner contour of the powder metal forging.

21. The method of claim 1, wherein, during the compression step, the upper section of the preform is injected downwardly by the upper punch from the top die into the lower die.

* * * * *